US009504894B1

(12) United States Patent
Patakos

(10) Patent No.: US 9,504,894 B1
(45) Date of Patent: Nov. 29, 2016

(54) HAND HELD MARTIAL ARTS STRIKING PADDLE

(71) Applicant: Nick Patakos, South River, NJ (US)

(72) Inventor: Nick Patakos, South River, NJ (US)

( * ) Notice: Subject to any disclaimer, the term of this patent is extended or adjusted under 35 U.S.C. 154(b) by 0 days.

(21) Appl. No.: 14/859,224

(22) Filed: Sep. 18, 2015

(51) Int. Cl.
*A63B 69/34* (2006.01)
*A63B 69/00* (2006.01)

(52) U.S. Cl.
CPC ..... *A63B 69/004* (2013.01)

(58) Field of Classification Search
None
See application file for complete search history.

(56) References Cited

U.S. PATENT DOCUMENTS 3,048,399 A * 8/1962 Breitbach ..... A63B 51/04 473/457
4,075,922 A * 2/1978 Smith ..... G10K 3/00 446/422
4,810,228 A * 3/1989 Huggins ..... A63H 5/00 16/385
5,112,266 A * 5/1992 Hall ..... A63H 5/00 24/442
5,160,147 A * 11/1992 Ping ..... A63B 59/20 273/DIG. 30
5,217,222 A * 6/1993 Rudell ..... A63B 51/04 473/528
5,249,810 A * 10/1993 Cazalet ..... A63B 67/20 273/330
5,326,097 A * 7/1994 Yu ..... A63B 59/80 473/528
5,672,131 A * 9/1997 Osborne ..... A63B 24/0006 463/9
5,816,580 A * 10/1998 Osborne ..... A63B 24/0006 273/454
6,471,564 B1 * 10/2002 Coleman ..... A63B 67/20 273/330
6,910,978 B2 * 6/2005 Cooper ..... A63B 49/08 473/521
7,485,786 B2 * 2/2009 Delatorre ..... G10K 3/00 84/402
7,935,034 B2 * 5/2011 Oh ..... A63B 69/004 482/83

* cited by examiner

*Primary Examiner* — Stephen Crow
(74) *Attorney, Agent, or Firm* — Porzio, Bromberg & Newman, P.C.

(57) ABSTRACT

A sonic paddle is a hand held device used for Martial arts striking practice. The sonic paddle is formed of layers of dense foam, rigid plastic, and plastic film resonating sheets. A cushioning layer is positioned on an outer surface of each of the resonating layers. The rigid center, supporting layers, resonating layers, and cushioning layers can be coupled to one another in sandwiched relationship. The part that the person strikes is the cushioning layers on either side of the paddle which are smaller in circumference than the resonating sheets leaving the resonating sheets protruding in order to resonate upon impact and thereby creating a loud sound when hit.

20 Claims, 3 Drawing Sheets

HAND HELD MARTIAL ARTS STRIKING PADDLE

BACKGROUND OF THE INVENTION

1. Field of the Invention

The present invention relates to a hand held training aid for martial art instructions and training and in particular to a hand-held noise making striking pad including a pair of resonating sheets of plastic film.

2. Description of Related Art

Martial arts, boxing, and self-defense arts are widely taught to both adults and children. The training in martial arts and the like may be done on the classroom level or by way of individual one-on-one instruction. Intrinsic with learning martial arts and the like is the teaching of the proper techniques for kicking and punching. Conventional devices have been utilized in teaching the proper techniques for kicking and punching. Convention devices include punching bags which include heavy bags and speed bags, target mitts which are worn on the hands of the instructor who is known as the sensei in martial arts, punching dummies, and wall and floor mounted punching targets.

It is advantageous for the teaching process if the device for teaching kicking and/or punching technique is hand held by the instructor. In the manner, the instructor or sensei can interact immediately with the student and make immediate comments or corrections when required.

It is also advantageous if the hand-held teaching device emits an audibly loud and distinctive sound when struck flush in the target area. This gives immediate feedback to the student or practitioner and a sense of satisfaction when the target is struck properly thereby giving the student the motivation to continue to strike the teaching device flushly and thereby improving the student's skill level.

A conventional hand-held device is the so-called "clapper." The clapper device is a tennis racket shaped device having two hingedly-attached paddle-shaped heads which clap against each other when struck, thereby emitting a noise. There are several disadvantages to such clapper devices. First, if struck incorrectly, it may be painful to the practitioner or even cause injury. Second, because it makes its noise through mechanically attached paddle heads and has moving parts, it is difficult to manufacture and comparatively fragile.

It is desirable to provide a hand-held device for use in the teaching of the proper technique for kicking and/or punching for use with martial-arts instruction, boxing instruction, self-defense arts and the like that emit an audibly loud and distinctive sound when struck in the target area.

SUMMARY OF THE INVENTION

The present invention relates to a sonic paddle which is a hand held device used for Martial arts striking practice. The sonic paddle is formed of layers of dense foam, rigid plastic, and plastic film resonating sheets. A cover can house at least a portion of the striking device. At one end of the striking paddle is a handle. The handle can include a curve at the distal end so that the paddle does not slip away from the holders hand. An elastic strap can be attached to end of the paddle. The elastic strap can be adapted to go around the wrist of the holder's arm further securing the paddle in the holder's hand. A paddle portion can have a rounded or elliptical shape. In one embodiment, the paddle is in the shape of a head of a tennis racket.

The sonic paddle can include a rigid center. The rigid center can be formed of hard foam or rigid plastic. The rigid center can include a paddle portion and an integral handle at the distal end thereof. Support layers can be positioned on either side of the paddle portion of the rigid center. The support layers can be formed of hard plastic. The rigid center and support layers can have a paddle shape for supporting both sides of the paddle portion in order to keep the paddle portion from breaking at the handle portion when hit. The support layers can have the same shape as the rigid center and being smaller in dimensions.

Coupled to an outer surface of the support layers on either side is a resonating layer. The resonating layers can be formed of a plastic film. For example the resonating layers can be formed of an "x-ray" film. The resonating layers can protrude from the outer circumference of the paddle portion edges and taper as they get closer to the handle. For example, the resonating layers can extend two inches from the paddle portion of the rigid center.

A cushioning layer is positioned on an outer surface of each of the resonating layers. The cushioning layer can be formed of dipped foam. The cushioning layer provides cushioning and no hard edges for the paddle. A visual target can be printed or adhered to a portion of sonic paddle. The visual target can include target graphics.

The rigid center, supporting layers, resonating layers and cushioning layers can be coupled to one another in sandwiched relationship. In one embodiment, each of the resonating layers can include an aperture so that the layers can be glued together as one working unit. The part that the person strikes when using the sonic paddle is the cushioning layers on either side of the paddle which are smaller in circumference then the resonating sheets leaving the resonating sheets protruding in order to resonate upon impact and thereby creating a loud sound when hit.

The sonic paddle is completely different than other conventional paddles by the use of the resonating sheets and positioning that creates a satisfying sound for feedback and motivation to the practitioner.

Because the sonic paddle of the present invention is hand held, the instructor has the total freedom to hold the paddle at any height or any orientation. This makes the target extremely versatile, handy, and safe for the instructor, student, and bystanders. The device will help the practitioner to master kicks, hand strikes, and even blocks by consistently forcing the practitioner to adjust his or her focus, speed, power, and direction on the target.

The invention will be more fully described by reference to the following drawings.

DETAILED DESCRIPTION

Figure 1:
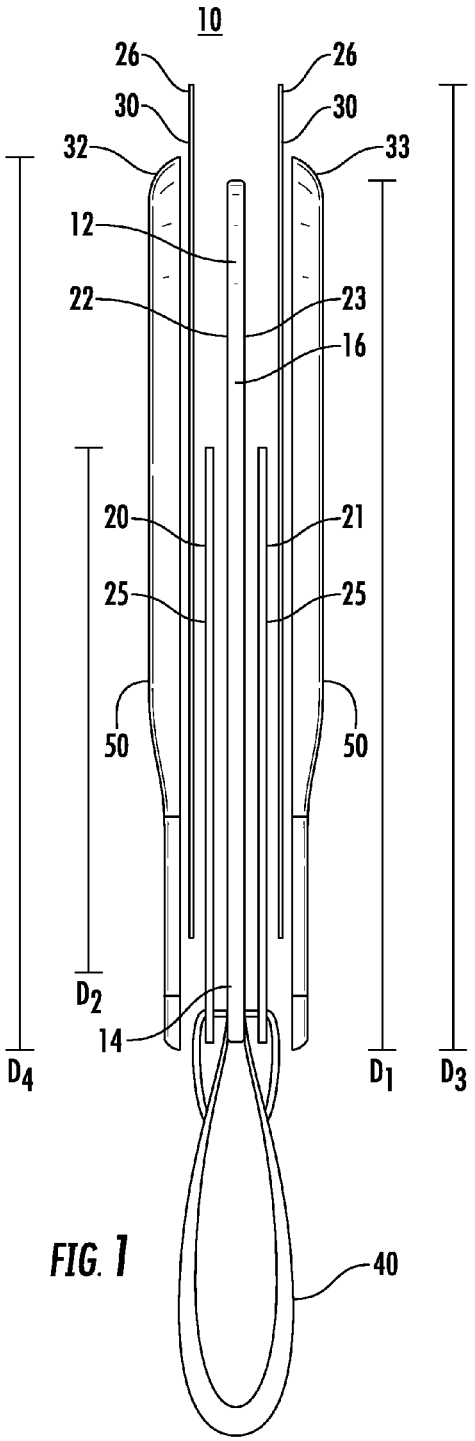
FIG. 1 is a schematic diagram of a paddle in accordance with the teachings of the present invention.

Reference will now be made in greater detail to a preferred embodiment of the invention, an example of which is illustrated in the accompanying drawings. Wherever possible, the same reference numerals will be used throughout the drawings and the description to refer to the same or like parts.

FIG. 1 illustrates sonic paddle 10 in accordance with the teachings of the present invention. Sonic paddle 10 includes paddle section 11. Paddle section 11 can be generally oval in shape. Alternatively, paddle section 11 can be circular or square. Sonic paddle 10 can be formed of rigid center 12 having handle 14 at distal end 15. Rigid center 12 can be formed of hard foam or rigid plastic. Rigid center 12 can include a paddle portion 16 integral with handle 14. Handle 14 can include grip portion 17. Grip portion 17 can be curved. Handle 14 can have a size and configuration chosen with the user in mind. As such, the size may be increased for use by a large adult martial-arts practitioner. Likewise, the size may be decreased with a child user in mind. Rigid center 12 can be formed of a rigid foam.

Support layers 20, 21 can be positioned on a respective side 22, 23 of paddle portion 16. Support layers 20, 21 can be formed of hard plastic such as for example PVC. Support layers 20, 21 can have a diameter $D_2$ which is smaller than a diameter $D_1$ of paddle portion 16 of rigid center 12.

Coupled to outer surface 25 of support layers 20, 21 are one or more resonating layers 26. Resonating layers 26 can be formed of a plastic film, for example the resonating layers 26 can be formed of an X-ray film. X-ray film is a thin plastic film, such as PET plastic or cellulose acetate which has been coated with an emulsion of gelatin and silver. Lower edge 29 of resonating layers 26 can taper towards handle 14. One or more resonating layers 26 emit a characteristic sound when struck by the hand or foot of the practitioner who is punching or kicking sonic paddle 10. In one embodiment, a pair of resonating layers 26 are used in sonic paddle 10.

Figure 2:
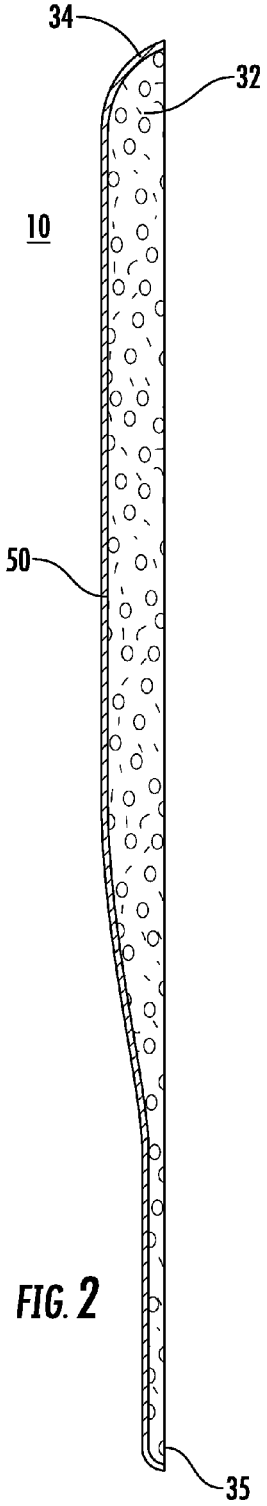
FIG. 2 is a schematic diagram of a cushioning layer used in the paddle.

Cushioning layers 32 is positioned on outer surface 30 of each of the one or more resonating layers 26 as shown in FIG. 2. Cushioning layers 32 can be formed of dipped foam. For example the dipped foam can be a nitrile rubber such as NBR which is a synthetic rubber copolymer of acrylonitrile (ACN) and butadiene. Cushioning layers 32, 33 can be rounded at upper end 34. Cushioning layers 32 can be tapered at lower end 35. Resonating layer 26 can have a diameter $D_3$ of paddle portion 28 which is larger than $D_4$ of cushioning layers 32. For example, resonating layer 26 can extend between one and three inches and preferably two inches from paddle portion 16 of rigid center 12. Cushioning layers 32 covers resonating layer 26 thereby providing a measure of protection against the strikes of the user using sonic paddle 10. The outward extension of the resonating layer 26 further amplifies and makes more distinctive the sound that sonic paddle 10 makes upon being kicked or punched by the practitioner.

Figure 3:
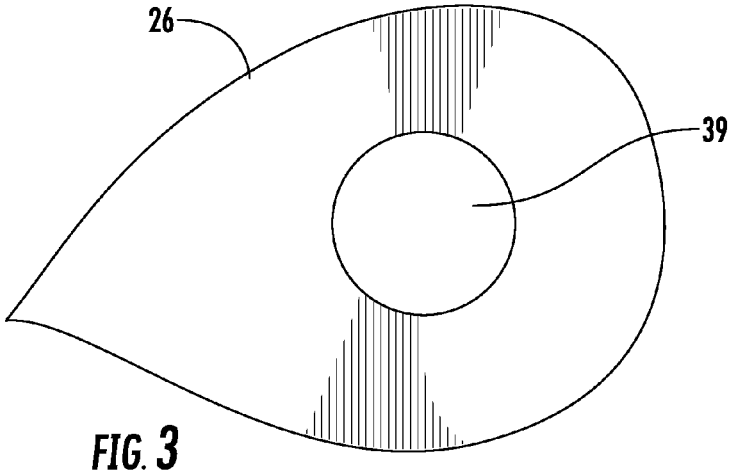
FIG. 3 is a schematic diagram of a resonating layer used in the paddle.
Figure 4:
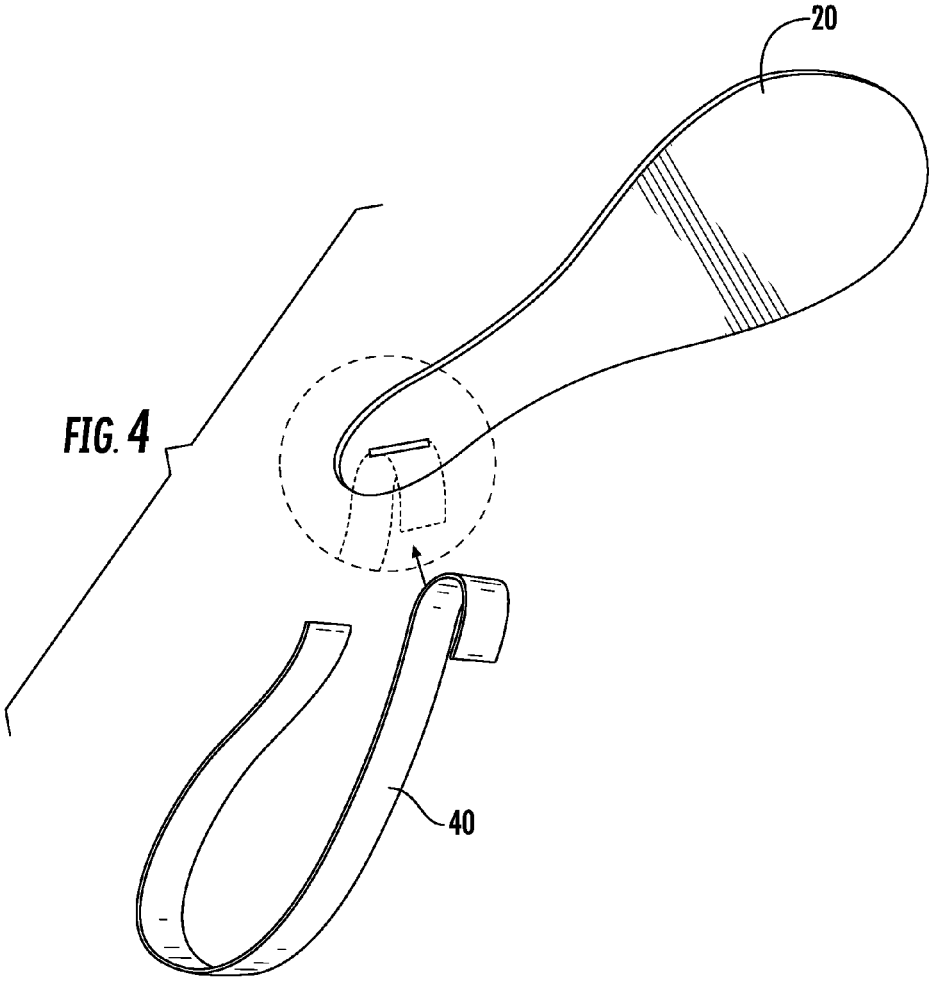
FIG. 4 is a schematic diagram of a side view of a supporting layer used in the paddle.

Rigid center 12, supporting layers 20, one or more resonating layers 26, and one or more cushioning layers 32 can be coupled to one another in a sandwiched relationship. One or more resonating layers 26 can include an aperture 33 as shown in FIG. 3. Aperture 39 of one or more resonating layers 26 can be coupled to supporting layers 20 and one or more cushioning layers 32. For example, glue can be used to couple aperture 39 of one or more resonating layers 26 to respective supporting layers 20 and one or more cushioning layers 32.

Referring to FIG. 1, strap 40 can be attached to handle 14. In one embodiment, strap 40 is attached through aperture 42 in handle 14. Strap 40 can extend through slit 43 formed in supporting layer 20 and end 45 of strap 40 can be flued to end 46 of strap 40. Strap 40 can be formed of an elastic material. Grip 44 can extend around handle 14. Grip 44 can be formed of a grip tape.

Figure 5:
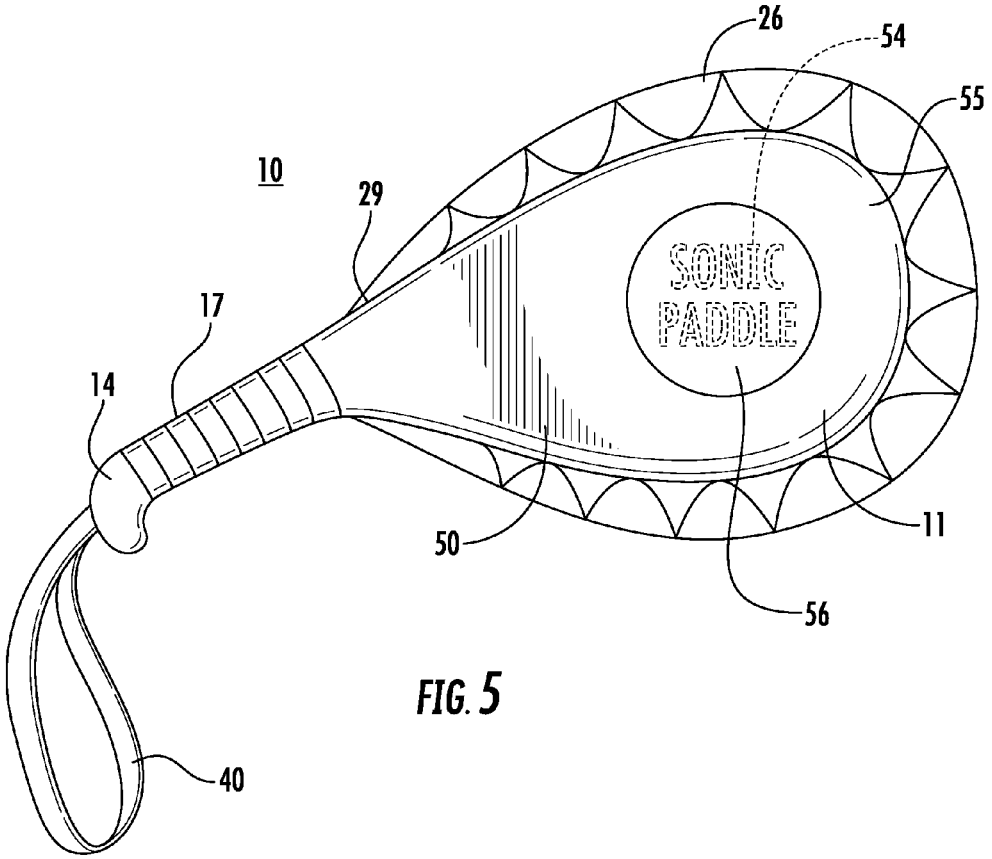
FIG. 5 is a schematic diagram of a side view of the paddle.

Cover 50 can house paddle portion 11 as shown in FIG. 5. Cover 50 can be formed of vinyl which is attached to one or more cushioning layers 32. Target portion 54 can be positioned on outer surface 55 of cover 50. Target portion 54 can include graphics 56. Graphics can be pictorial or indicia. Target portion 54 and resonating layers 26 provide a larger visual target than a conventional target without adding weight to the handle.

It is to be understood that the above-described embodiments are illustrative of only a few of the many possible specific embodiments, which can represent applications of the principles of the invention. Numerous and varied other arrangements can be readily devised in accordance with these principles by those skilled in the art without departing from the spirit and scope of the invention.

What is claimed is:

1. A paddle comprising:

a rigid center, said rigid center including a paddle portion and a handle at distal end;

one or more resonating layers coupled to a side of said rigid center paddle portion; and a cushioning layer coupled to an outside surface of each of the one or more resonating layers;

wherein said resonating layer extends beyond a diameter of said cushioning layer and are adapted to provide a sound when said cushioning layer is struck.

2. The paddle of claim 1 wherein the paddle portion of said rigid center has an oval shape.

3. The paddle of claim 1 wherein said rigid center is formed of hard foam or rigid plastic.

4. The paddle of claim 1 further comprising support layers positioned on either side of said rigid center between said one or more resonating layers.

5. The paddle of claim 4 wherein said support layers are formed of hard plastic.

6. The paddle of claim wherein 4 the support layers have a diameter $D_2$ which is smaller than a diameter $D_1$ of the paddle portion of the rigid center.

7. The paddle of claim 1 wherein the one or more resonating layers are formed of a plastic film.

8. The paddle of claim 7 wherein the one or more resonating layers are formed of X-ray film.

9. The paddle of claim 1 wherein the one or more resonating layers include a paddle portion and a diameter $D_3$ of the paddle portion of the one or more resonating layers is larger than a diameter $D_4$ of the support layers.

10. The paddle of claim 9 wherein diameter $D_3$ is between one and three inches larger than diameter $D_4$.

11. The paddle of claim 9 wherein diameter $D_3$ is two inches larger than diameter $D_4$.

12. The paddle of claim 9 wherein lower edges of the one or more resonating layers taper towards the handle of the rigid center.

13. The paddle of claim 1 wherein the cushioning layer is formed of dipped foam.

14. The paddle of claim 1 wherein the cushioning layer is rounded at an upper end and tapered at a lower end, the lower end being positioned adjacent said handle.

15. The paddle of claim 4 further comprising a strap attached to said handle, said strap extending through said support layers.

16. The paddle of claim 1 wherein the handle includes a grip portion.

17. The paddle of claim 1 wherein the handle is curved.

18. The paddle of claim 4 wherein the rigid center, supporting layers, one or more resonating layers and respective cushioning layer are coupled to one another in a sandwiched relationship.

19. The paddle of claim 1 further comprising a cover attached to the cushioning layer and a target portion positioned on an outer surface on at least one side of the cover.

20. The paddle of claim 1 comprising a pair of resonating layers.

* * * * *